US006502676B2

(12) United States Patent
Dexheimer

(10) Patent No.: US 6,502,676 B2
(45) Date of Patent: Jan. 7, 2003

(54) LUGGAGE INCLUDING A REMOVABLE CARRIER BAG

(75) Inventor: Lee Dexheimer, Portland, OR (US)

(73) Assignee: Bonfire Snowboarding, Inc., Portland, OR (US)

( * ) Notice: Subject to any disclaimer, the term of this patent is extended or adjusted under 35 U.S.C. 154(b) by 0 days.

(21) Appl. No.: 09/773,712

(22) Filed: Feb. 2, 2001

(65) Prior Publication Data

US 2002/0104725 A1 Aug. 8, 2002

(51) Int. Cl.[7] ..... A45C 3/00
(52) U.S. Cl. ..... 190/108; 150/111; 150/113
(58) Field of Search ..... 190/108, 110, 190/102, 109, 111, 18 A; 150/111, 113; 383/37; 206/315.1, 289

(56) References Cited

U.S. PATENT DOCUMENTS 3,122,225 A * 2/1964 Ward ..... 190/52
3,696,850 A * 10/1972 Rosenblum ..... 190/108
4,358,137 A * 11/1982 Gramm ..... 280/814
4,883,207 A * 11/1989 McArthur ..... 224/153
5,538,137 A * 7/1996 Deioma et al. ..... 190/109
D392,801 * 3/1998 Hields et al. ..... D3/261
5,749,503 A * 5/1998 Wulf et al. ..... 224/153
5,875,876 A * 3/1999 Wang ..... 190/18 A
5,971,119 A * 10/1999 Chi ..... 190/108
6,119,858 A * 9/2000 Davidson ..... 99/345
6,213,267 B1 * 4/2001 Miller ..... 190/108

* cited by examiner

*Primary Examiner*—Lee Young
*Assistant Examiner*—Lien Ngo
(74) *Attorney, Agent, or Firm*—Greenblum & Bernstein, P.L.C.

(57) ABSTRACT

Luggage that includes a bag that is capable of housing an elongated article of leisure, such as a snowboard or skis, the bag including an arrangement to enable it to be attached to a main article of luggage having substantially the same length.

17 Claims, 2 Drawing Sheets

10
12
14
16
18
19
20
22
24
26
28
30
32
32
36
38
38

LUGGAGE INCLUDING A REMOVABLE CARRIER BAG

BACKGROUND OF THE INVENTION

1. Field of the Invention

The present invention relates to the field of luggage adapted particularly to the transport of elongated articles of leisure such as skis or snowboards.

2. Description of Background and Relevant Information

The enthusiasts of sports such as snowboarding and skiing usually must travel to the locations where they can engage in their sporting activities. Therefore, they must carry articles for their personal use as well as their sports apparatus, which can often have a length of more than 140 centimeters.

Bags already exist, whose elongated shape is provided to enable them to house a gliding apparatus, i.e., such as a snowboard or skis. These bags, which make it possible to protect the apparatus from impacts, also include a structure for gripping such bags that facilitate the carrying thereof.

However, when the user also brings articles for personal use, he/she must have a separate main luggage. However, especially when the user uses public transportation such as an airplane or the train, he/she must then carry along two distinct pieces of luggage, which is often impractical, especially as this luggage is cumbersome.

SUMMARY OF THE INVENTION

Therefore, an object of the invention is to propose a new article of luggage, or a system of luggage, that is particularly adapted to the specific constraints faced by the user of elongated gliding apparatuses.

To this end, the invention proposes a luggage that includes a bag that is capable of housing an elongated gliding apparatus, the bag having an arrangement enabling it to be attached to a main luggage having substantially the same length.

BRIEF DESCRIPTION OF DRAWINGS

Other characteristics of the invention will become apparent upon reading the detailed description that follows, with reference to the annexed drawings, in which.

DETAILED DESCRIPTION OF THE INVENTION

Figure 1:
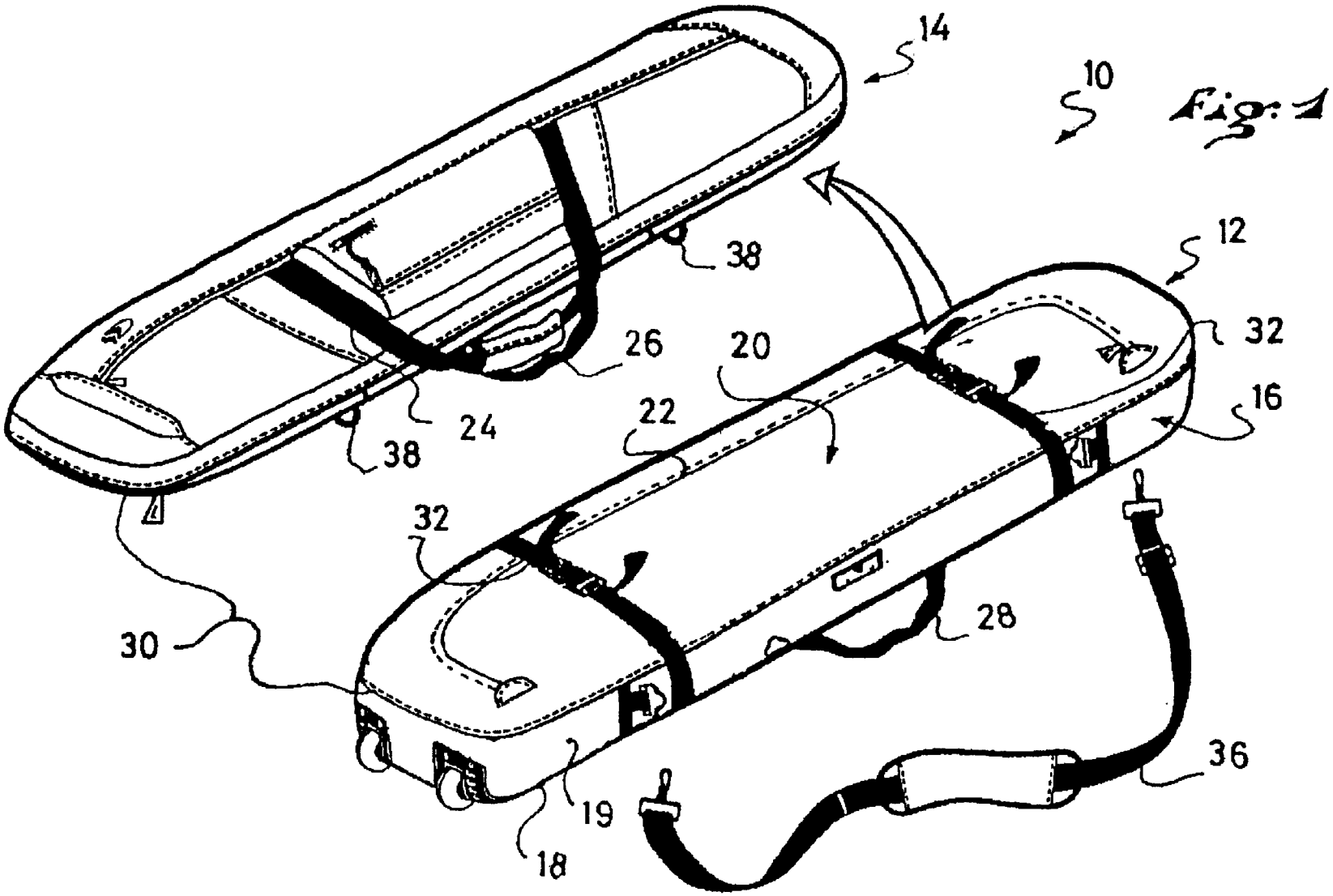
FIG. 1 is a perspective view of an embodiment of luggage according to the invention, the bag and the main luggage shown being separated from one another.

FIG. 1 shows luggage 10, or a system of luggage, that is composed of two parts: a main article of luggage 12 and a carrier bag 14 capable of housing an elongated article of leisure, such as a pair of skis or a snowboard. Such apparatuses are generally more than 140 centimeters long, and can reach up to two meters or more.

The bag is essentially in the form of a relatively thin sheath, generally made of a thick flexible fabric, whose contour has a shape corresponding to that of the apparatus to be carried. Since the bag is thin, it can be formed of two parallel panels assembled directly by their contour, without the presence of an intermediate thickness panel. However, in certain cases, the presence of such a thickness panel can prove useful. Similarly, it can be advantageous to provide that the constituent material of the bag be padded. The bag 14 is provided with a closable opening that enables one to introduce the gliding apparatus therein.

The bag 14 includes a gripping arrangement that makes it possible to carry it easily. In the example shown, the bag 14 includes two similar straps 24, 26, each of which is sewn on one of the surfaces of the bag, and each of which overlaps transversely outwardly with respect to the contour of the bag, beyond an elongated edge thereof. The two straps 24, 26 thus form a handle that makes it possible to carry the bag in a vertical plane, its greatest length extending horizontally.

The main luggage 12 shown in FIG. 1 has the same contour as the bag 14, but it is thicker. However, besides the fact that it has substantially the same length as the bag 14, the main luggage could have a greater width than that of the bag 14, especially if the latter is provided to receive a narrow apparatus such as a pair of skis.

Preferably, it includes a rigid or semi-rigid shell 16, which can be made, in a non-limiting manner, in a single piece obtained by molding a rigid material. The shell 16 forms a bottom wall 18 of the luggage, this wall 18 having the same contour as the bag 14, and it also forms side thickness surfaces 19 of the main luggage 12. The upper surface 20 of the main luggage 12 is formed, for example, with a flexible upper panel that closes the shell but is provided with a closable opening 22 allowing access to the inner volume of the main luggage 12. The closable opening is constituted, for example, by a zipper. However, the shell 16 could also be closed by a rigid cover.

This shell could also be made in the form of a rigid structure on which flexible panels are to be fixed. One can also provide that only the bottom wall 18 is to be stiffened.

The bag 14 is adapted to be fixed against the upper surface 20 of the main luggage 12. According to a preferred embodiment of the invention, the bag 14 is attached on the main luggage 12 by a zipper 30 that extends along the contour common to the bag 14 and to the upper surface 20 of the main luggage 12. In the example shown, the zipper 30, which can be considered a zipper that is shared between the bag 14 and main luggage 12, extends over the entire contour of the luggage. However, one can provide that the zipper be interrupted over a certain length on one of the edges.

The continuity of the connection formed by the zipper makes it possible to prevent any object from being inserted accidentally between the bag and the main luggage, at the risk of separating them by a lever effect. This is particularly appreciable during transportation by airplane, when luggage can be subject to handling without care in airports. Conversely, the continuous connection ensured by the zipper makes it possible to form a compartment between the bag and the main luggage in which a flat object, which does not run the risk of falling out, can possibly be introduced.

Figure 2:
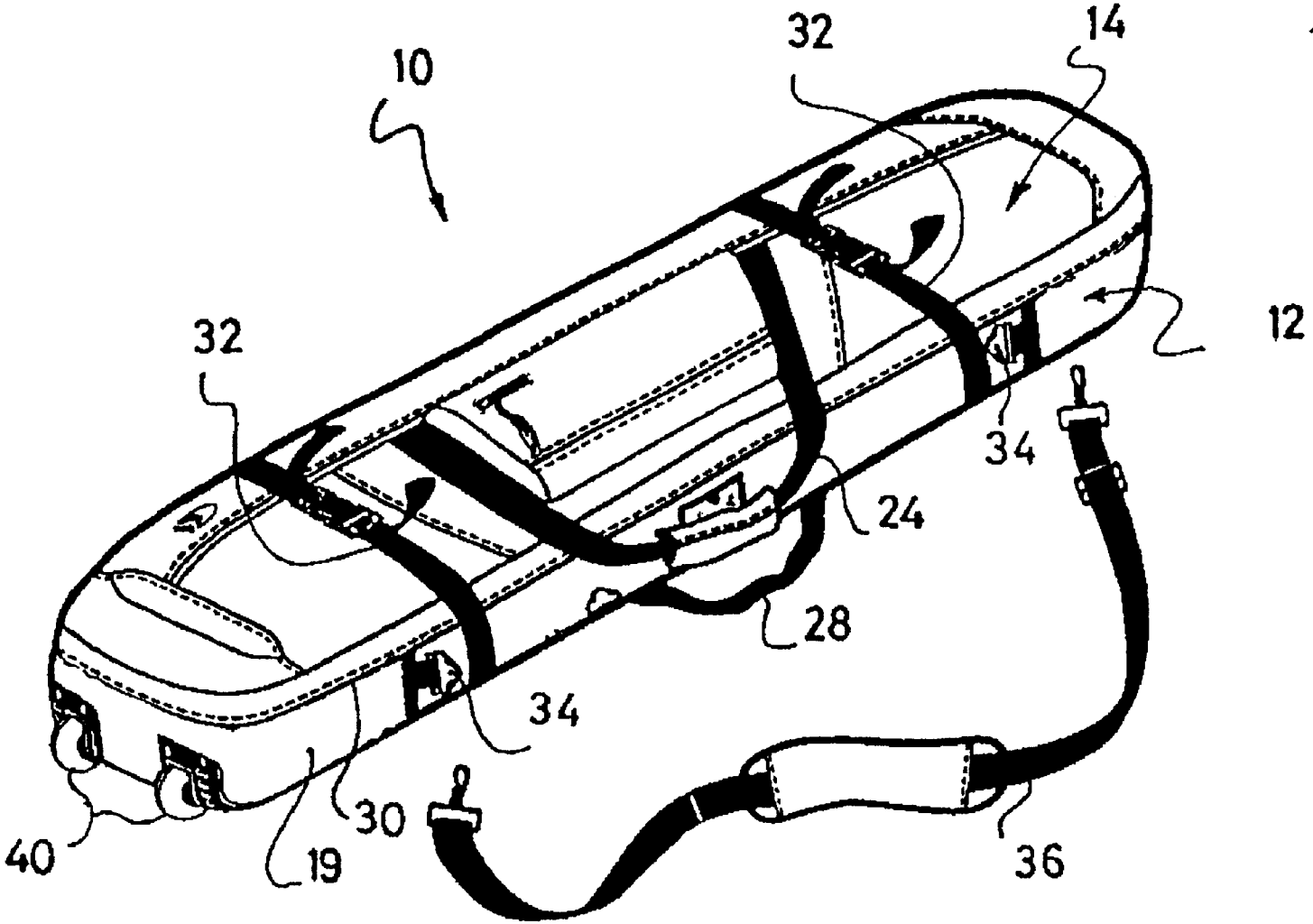
FIG. 2 is a view similar to that of FIG. 1, in which the bag is attached to the main luggage.

As a safety measure, one can however provide to reinforce the fastening of the bag on the main luggage 12 with one or two tightening straps 32 that surround the assembly formed by the main luggage 12 and the bag 14, the straps 32 being capable of being used on the main luggage 12 alone, as shown in FIG. 1, or on the complete luggage 10 as shown in FIG. 2.

With the arrangement shown, the bag 14 seals the closable opening 22. Therefore, one can provide that the closable opening be arranged on a surface of the main luggage other than the surface on which the bag 14 is fixed.

Furthermore, one can see that the main luggage 12 has a strap 28 that is similar to the straps 24, 26 of the bag 14. This strap 28 is arranged on the bottom wall 18, i.e., the wall opposite that against which the bag 14 is attached. Indeed, the strap 26, which is sewn on the surface of the bag 14 coming in contact with the main luggage 12, is confined when the bag is attached to the main luggage. The presence of the zipper 30 prevents this strap from extending outwardly of the contour of the luggage. Thus, in this case, a carrying handle is obtained by using the other strap 24 of the bag and the strap 28 of the main luggage 12, as can be seen in FIG. 2. That is, if the bag 14 is considered to have first and second straps 24 and 26, which can be brought together to carry the bag 14 when detached from the main luggage 12, the strap 28 of the main luggage can be considered to be a third strap that can be brought together with the first strap 24 to carry the combination of bag and main luggage when they are attached.

The main luggage 12 includes, on one of its elongated side surfaces, two spaced-apart attachment elements, in the form of rings 34, for fixing a detachable shoulder strap 36 that makes it possible to carry the luggage on the shoulder. Furthermore, two other spaced-apart attachment elements, i.e., rings 38, are found on one of the elongated edges, or sides, of the contour of the bag 14, such that the shoulder strap 36 can also be used to carry the bag 14 when the latter is separated from the main luggage 12.

Advantageously, the shell 16 is provided, at one of its ends, with rollers 40 that enables one to roll the luggage behind them by pulling it by the other end, which saves the trouble of carrying all the weight of the luggage 10.

The luggage according to the invention makes it possible to easily carry an article of leisure, such as a gliding apparatus, at the same time as other articles of personal use. Once on location, the user can separate the carrier bag from the main luggage, and he/she can even use the shoulder strap of the luggage to carry the bag alone on the shoulder.

What is claimed is:

1. A system of luggage comprising:

an article of primary luggage including an upper side, an opening formed in said upper side to allow access to an inner volume of said article of primary luggage, said opening being defined by a pair of mating edges brought together to close said opening by a closure mechanism;

a bag having a size and shape to enable housing at least one gliding board, said bag including an attaching arrangement to enable said bag to be attached to said article of primary luggage, said bag and said article of primary luggage having substantially an identical length of equal to or greater than 140 centimeters, wherein said bag covers said upper side of said article of primary luggage and said pair of mating edges when said bag is attached to said article of primary luggage by means of said attaching arrangement.

2. A system of luggage according to claim 1, wherein said attaching arrangement extends substantially along a periphery of said bag, including along a length and along a width of said bag.

3. A system of luggage according to claim 2, wherein said attaching arrangement is a zipper.

4. A system of luggage according to claim 1, wherein said bag and said article of primary luggage have substantially a common length and a common width.

5. A system of luggage according to claim 1, in combination with said at least one gliding board.

6. A system of luggage according to claim 1, wherein said bag has a smaller width than a width of said article of primary luggage.

7. A system of luggage according to claim 1, wherein said closure mechanism of said article of primary luggage comprises a zipper.

8. A system of luggage according to claim 1, wherein:

said bag includes a lower side and an upper side;

said upper side of said article of primary luggage faces said lower side of said bag when said bag is attached to said article of primary luggage by means of said attaching arrangement;

said bag further includes a first carrying strap extending from said lower side of said bag beyond a predetermined elongated edge of said bag and a second carrying strap extending from said upper side of said bag beyond said predetermined elongated edge of said bag, said first and second carrying straps being mounted to said bag to be brought together to enable said bag to be carried when said bag is separated from said article of primary luggage; and said article of primary luggage includes a third carrying strap mounted to said article of primary luggage to enable said first carrying strap and said third carrying strap to be brought together to enable both said bag and said article of primary luggage to be carried when said bag is attached to said article of primary luggage by means of said attaching arrangement.

9. A system of luggage according to claim 8, wherein said article of primary luggage further comprises a detachable shoulder strap attached to an elongated side surface of said article of primary luggage.

10. An assembly according to claim 5, wherein said at least one gliding board consists of a pair of skis.

11. An assembly according to claim 5, wherein said at least one gliding board consists of a snowboard.

12. An assembly according to claim 1, wherein said article of primary luggage has a greater thickness than a thickness of said bag.

13. A system of luggage comprising:

an article of primary luggage having an upper side, an opening formed in said upper side to allow access to an inner volume of said article of primary luggage and a zipper closure extending along said edges formed in said upper side for closing said opening;

a bag having a size and shape to enable housing at least one gliding board, said bag and said primary luggage having substantially an identical length of 140 centimeters or more;

a contour of a predetermined length common to both said article of primary luggage and said bag; and a shared zipper closure having complementary portions on said article of primary luggage and said bag for attaching said article of primary luggage and said bag along said contour, with said bag covering said opening on said upper side of said article of primary luggage.

14. A system of luggage according to claim 13, wherein:

said bag includes a lower side and an upper side;

said upper side of said article of primary luggage facing said lower side of said bag when said bag is attached to said article of primary luggage by means of said attaching arrangement;

said bag further includes a first carrying strap extending from said lower side of said bag beyond a predetermined elongated edge of said bag and a second carrying strap extending from said upper side of said bag beyond said predetermined elongated edge of said bag, said first and second carrying straps being mounted to said bag to be brought together to enable said bag to be carried when said bag is separated from said article of primary luggage; and said article of primary luggage includes a third carrying strap mounted to said article of primary luggage to enable said first carrying strap and said third carrying strap to be brought together to enable both said bag and said article of primary luggage to be carried when said bag is attached to said article of primary luggage by means of said attaching arrangement.

15. A system of luggage according to claim 14, wherein said article of primary luggage further comprises a detachable shoulder strap attached to an elongated side surface of said article of primary luggage.

16. A system of luggage according to claim 1, wherein said article of primary luggage includes a pair of opposite elongated sides and said bag includes a pair of opposite elongated sides, wherein a pair of spaced-apart attachment elements are located on one of said elongated sides of said article of primary luggage and a pair of spaced apart attachment elements are located on one of said elongated sides of said bag, and wherein said system of luggage further includes a detachable shoulder strap selectively attachable to said pair of spaced-apart attachment elements of said article of primary luggage or to said pair of spaced-apart attachment elements of said bag.

17. A system of luggage according to claim 13, wherein said article of primary luggage includes a pair of opposite elongated sides and said bag includes a pair of opposite elongated sides, wherein a pair of spaced-apart attachment elements are located on one of said elongated sides of said article of primary luggage and a pair of spaced apart attachment elements are located on one of said elongated sides of said bag, and wherein said system of luggage further includes a detachable shoulder strap selectively attachable to said pair of spaced-apart attachment elements of said article of primary luggage or to said pair of spaced-apart attachment elements of said bag.

* * * * *